United States Patent [19]

Ray

[11] 4,256,464

[45] Mar. 17, 1981

[54] PROCESS FOR DESULFURIZATION OF COAL

[75] Inventor: Asim B. Ray, Bridgewater, N.J.

[73] Assignee: Research-Cottrell, Inc., Somerville, N.J.

[21] Appl. No.: 80,677

[22] Filed: Oct. 1, 1979

[51] Int. Cl.[3] ..... C10L 9/02; C10B 57/08

[52] U.S. Cl. ..... 44/1 SR; 201/17

[58] Field of Search ..... 44/1 SR; 201/17; 423/461

[56] References Cited

U.S. PATENT DOCUMENTS

| | | | |
|---|---|---|---|
| 2,726,148 | 12/1955 | McKinley et al. | 44/1 SR |
| 2,814,588 | 11/1957 | Hutchings | 201/17 X |
| 3,184,397 | 5/1965 | Work et al. | 201/17 X |
| 3,214,346 | 10/1965 | Mason et al. | 201/17 X |
| 3,393,978 | 7/1968 | Murphy et al. | 201/17 X |
| 3,909,211 | 9/1975 | Diaz et al. | 44/1 SR |
| 3,960,513 | 6/1976 | Agarwal et al. | 44/1 SR |
| 4,134,737 | 1/1979 | Yang | 44/1 SR |

*Primary Examiner*—Carl F. Dees

*Attorney, Agent, or Firm*—Kerkam, Stowell, Kondracki & Clarke

[57] ABSTRACT

Coal is oxidized by $NO_x$ in the presence of a liquid in which $NO_x$ is soluble. Oxidized sulfur species are removed by washing with water and dilute sulfuric acid. $NO_x$ is not consumed in the process and is recycled. More than 70% of sulfur in coal is removed.

5 Claims, 1 Drawing Figure

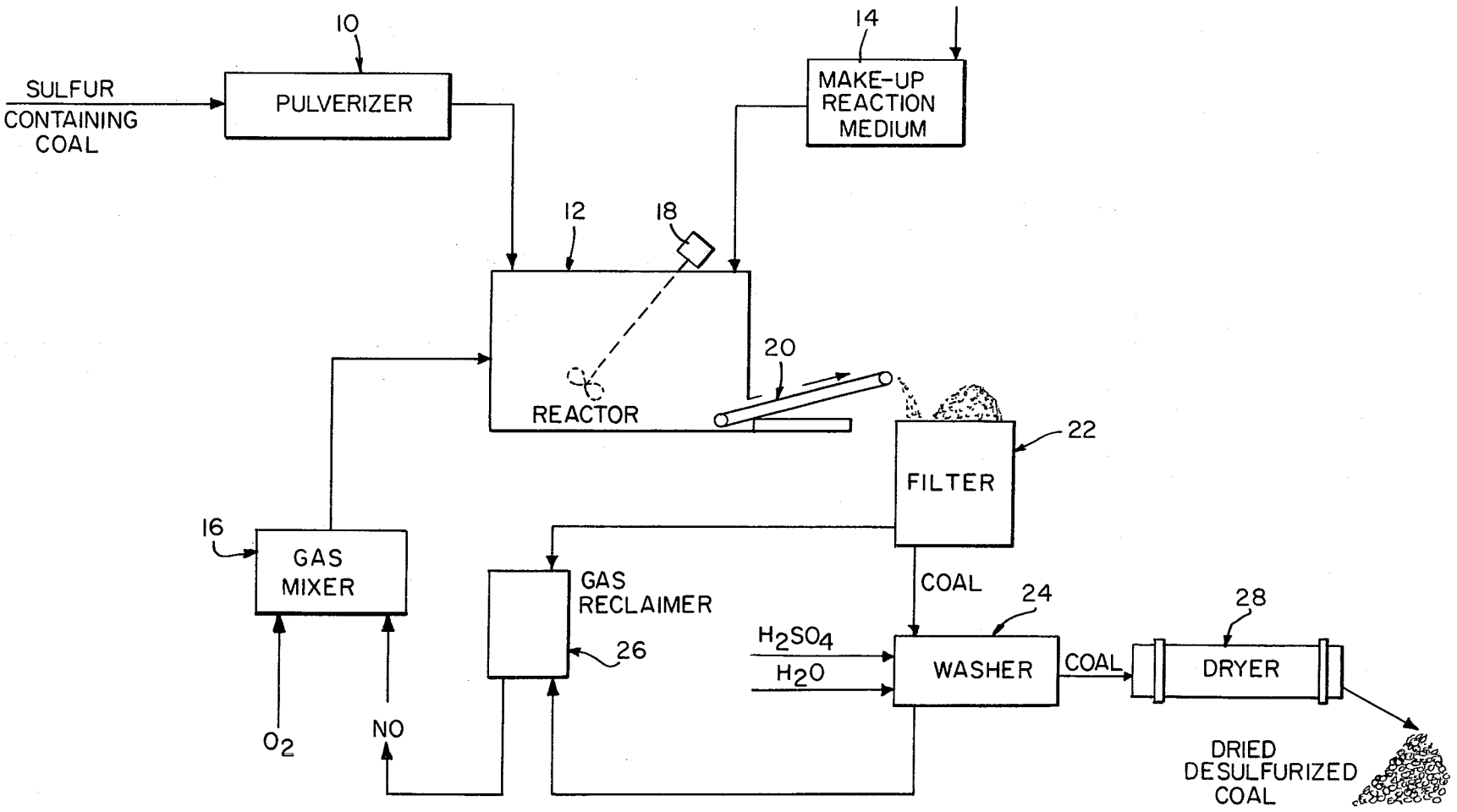
SULFUR CONTAINING COAL
10
PULVERIZER
12
REACTOR
14
MAKE-UP REACTION MEDIUM
16
GAS MIXER
18
20
22
FILTER
COAL
24
WASHER
$H_2SO_4$
$H_2O$
GAS RECLAIMER
26
NO
$O_2$
COAL
28
DRYER
DRIED DESULFURIZED COAL

PROCESS FOR DESULFURIZATION OF COAL

TECHNICAL FIELD

This invention is directed to a process for removing sulfur from pulverized coal, in a wet process, wherein no $SO_2$ or $SO_3$ is formed and the reaction is carried out at ambient temperature and the washing agents are water and sulfuric acid, or sodium carbonate.

BACKGROUND OF PRIOR ART

U.S. Pat. No. 3,909,211 is directed to a coal desulfurization process wherein powdered coal is reacted with a mixture of NO and air. The reaction temperature is 200° F. The reaction products, according to the patent, are $FeSO_4$, $SO_3$ or $SO_2$ and oxygenated organix sulfur compounds. After washing the oxygenated coal with water, it was further washed with 10–20% sodium hydroxide solution. After the caustic soda wash, the coal is again washed with water to remove any caustic absorbed by the coal particles. The coal is then dried.

The process of U.S. Pat. No. 3,909,211 has several disadvantageous factors in that $SO_2$ and $SO_3$ are formed during the reaction, thus it is necessary to scrub the $SO_2$ evolved using, for example, caustic soda and this will necessitate an additional operation. Also, washing the desulfurized coal with caustic soda has some disadvantages: it is difficult to remove from coal particles and the presence of sodium in coal could cause excess corrosion in boilers.

Further, the reaction temperature of the process is relatively high and care must be taken to prevent coal ignition.

Other prior art of interest is: U.S. Pat. No. 3,214,346 which discloses that acids may be employed to extract or wash coke after it has been reacted with a gaseous oxidizing agent;

U.S. Pat. No. 3,960,513, which discloses that coal may by desulfurized by suspending it in an aqueous medium and subjecting it to oxidation with oxygen at elevated temperatures;

U.S. Pat. No. 3,393,978, which relates to the desulfurization of particulate carbonaceous material in a fluidized bed with steam and an alkaline material. The patent also discloses the utilization of an acid to wash the thus treated material;

U.S. Pat. No. 2,814,588 discloses that coke may be desulfurized, utilizing such materials such as nitrogen, carbon dioxide, carbon monoxide, mathane, ethylene, water gas, anhydrous ammonia and hydrogen;

Similarly, U.S. Pat. No. 2,726,148 discloses that nitrogen, carbon monoxide, carbon dioxide, ammonia, water gas and hydrogen have been utilized to desulfurize coal; and U.S. Pat. No. 3,148,397 discloses a fluidized bed operation for desulfurizing coal.

BRIEF SUMMARY OF INVENTION

The improved process of the invention may be summarized as including suspending powdered sulfur containing coal in a liquid reaction medium generally inert to and a solvent for $NO_x$, and while suspended, introducing NO and oxygen or an oxygen containing gas. Following a predetermined reaction time, the suspended coal is filtered and washed with water which washing is preferably followed by washing with 1% $H_2SO_4$ and a further water washing and drying.

BRIEF DESCRIPTION OF DRAWING

The drawing is a block diagram representing the process for removing sulfur from coal in accordance with the teachings of the invention.

DETAILED DESCRIPTION OF INVENTION

Referring to the drawing which shows a representative continuous process arrangement for carrying out the present invention, 10 generally designates a coal crusher or pulverizer. Sulfur containing coal in crushed or raw form is fed to the pulverizer 10 which converts the raw coal into particles of a size permitting rapid processing. The size of the coal exiting from the pulverizer 10 to the continuous reactor 12 should be of a size that the coal can be readily suspended in the reaction medium contained within the reactor 12. The size of the coal will preferably range from about −100 mesh to as large as about ¼ inch in diameter. Pulverizers for accomplishing this commutation are well known and comprise commercially available equipment.

The reactor 12 receives the pulverized coal as shown in the drawing, and receives the reaction medium from reaction medium make up tank 14. Further, the reactor receives the gas mixture of oxygen or a gas containing oxygen and nitric oxide from the gas mixer 16. Within the reactor 12 is a commercial mixer designated 18 which maintains the pulverized coal in suspension in the reaction medium and insures good mixing between the reaction medium and the gas mixture. Reacted coal is removed from the reactor via a drainage conveyor generally designated 20.

Reacted coal from the drainage conveyor 20 is directed to a commercial filter. The reacted coal from the filter 22 is directed to a conventional scrubber or washer generally designated 24. The washer includes input for water wash and sulfuric acid washing of the coal. Both the filter 22 and the washer 24 are provided with means for circulating the filtrate and affluent respectively to a gas reclaimer 26 wherein nitric oxide is recovered for recirculation to the gas mixture. Other refinement such as means for recovering the unused sulfuric acid and any reaction medium passing to the coal filter 22 may be employed with the process. From the washer 24 the washed and desulfurized coal is passed to a conventional coal dryer illustrated as a rotary drum dryer 28.

PROCESS DETAILS

Powdered coal (mesh size −100 to +200) is suspended in an organic medium. The liquid medium should have the following properties:

(a) Inert to $NO_x$
(b) A good solvent for $NO_x$
(c) Low vapor pressure
(d) Innocuous
(e) Easily removed from coal A number of organic compounds can be used as a reaction medium. These include halogenated hydrocarbons like various freons, and chlorinated hydrocarbons like carbon tetrachloride, perchloroethylene, sulfur containing organic compounds like sulfoxides, and dimethyl sulfate and high molecular weight hydrocarbons like kerosine. For practical reasons, hydrocarbons like kerosine and halogenated compounds like freons or methylene chloride are most suitable for use as the reaction medium.

PROCESS CHEMISTRY

The following reactions are assumed to take place when coal, (containing some absorbed moisture) suspended in an organic liquid, is treated with a mixture of $NO_x$ and air.

$$2\,NO + O_2\,(Air) \longrightarrow 2\,NO_2$$

$$FeS_2 + 7\,NO_2 + H_2O \longrightarrow FeSO_4 + H_2SO_4 + 7\,NO$$

Pyrite $$R_2S + NO_2 \longrightarrow R_2SO + 2\,NO$$

Sulfoxide

R = Organic Radical $$R_2S + 2\,NO_2 \longrightarrow R_2SO_2 + 2\,NO$$

Sulfone

The ferrous sulfate is removed by washing with water and the oxygenated organic sulfur compounds are removed by washing with sulfuric acid. However, soda ash can be substituted for the sulfuric acid wash.

In each of the following examples the following reagents, concentrations and conditions were maintained:

The concentration of $NO_2$ in the gas mixture was about 10 volume percent. Reaction stoichiometry used in these reactions was 3 and the stoichiometry was defined as the ratio of moles of total $NO_2$ passed to the moles of sulfur in the quantity of coal used in the reaction. The rates of NO and air flows were changed to keep both the $NO_2$ concentration and reaction time constant under all reaction conditions. The volume of the reactor was selected such that more than 99% conversion of NO to $NO_2$ occurred. A sodium hydroxidehydrogen peroxide trap was used to absorb $NO_x$ and any $SO_x$.

After the reaction, the coal was homogenized and washed with various selected reagents. In all washings, two volumes of reagents were used for each volume of coal. In all washings the washing temperatures were 70°-80° F.

After washing, the coal was analyzed in order to determine the degree of sulfur removal and changes in carbon, hydrogen and nitrogen content of the coal at various process steps.

The following equation was used to measure the degree of sulfur removal in the different stages of the process:

$$S_E = \frac{So - Sf}{So} \times 100$$

Where, $S_E$=Sulfur removal efficiency (in percent).

So=Sulfur content of unreacted coal (in percent).

Sf=Sulfur content of product coal (in percent).

The higher the value of $S_E$, the better the desulfurization process. One part (by weight) of powdered coal was used in two parts (by weight) of reaction liquid. Through this suspension a mixture of NO and air was passed. The contents of the reactor was agitated by a teflon coated stirrer. The temperature of the reaction was monitored at all times, and all reactions were started at room temperature (about 72° F.), but during the reaction the temperature increased and the increase in temperature varied from 30° to 70° F. and was related to the sulfur content, degree and rate of oxidation of the sulfur in the coal. After the reaction, the coal was filtered, washed with preselected reagents, air dried and analyzed.

EXAMPLE I 100 gm of coal from Tuscaraws, Ohio (Middle Kittanning) containing C, 68.11%; H, 5.14%; N, 1.42%; S, 3.60%; was pulverized to −100 to +200 mesh and suspended in 200 gm. of kerosine in a reactor. A mixture of NO and air (10.4% NO and 89.6% air) was passed through the coal-kerosine suspension at 75° F. The reaction time was 3 hours and the reaction stoichiometry was 6. After the reaction, the coal was filtered and washed twice with water at 80° F. Each time the coal was washed with twice its volume of water. Analysis of the washed coal showed that it contained C, 65.15%; H, 4.80%; N, 2.30%; and S, 1.63%. Thus, 55% of the sulfur present in coal was removed by this procedure. No sulfuroxide was found in the NaHO trap.

EXAMPLE II

High sulfur Pennsylvania coal had the following unreacted compositions:

C, 72.45%; H, 4.87% N, 1.82%, S, 4.43%; Ash, 11.70%—BTU/lb. 13,343.

100 gm. of the above coal was pulverized to −100 to +200 mesh and suspended in 200 gm. of kerosine. A mixture of NO (9.5% by volume) and air (90.5% by volume) was passed through the mixture at 72° F. for 3 hours. The reaction stoichiometry was 2.90. The coal was filtered and then a portion of the homogenized coal was washed with water only at 80° F. The washed coal had the following properties:

C, 74.50%; H, 4.84%; N, 2.70%; S, 1.25%—BTU/lb. 13,328.

Thus, 72% of the sulfur was removed.

EXAMPLE III

The example set forth in Example II was repeated keeping all the conditions except the washings as before. The filtered coal was first washed (at 80° F.) with 1% $H_2SO_4$ and then with water (80° F.). The resultant coal had the following compositions:

C, 72.6%; H, 4.98%; N, 2.40%; S, 1.26%—BTU/lb. 12,888.

Sulfur removal efficiency was 76%.

EXAMPLE IV

Another portion of the above oxidized coal was first washed with 1% $Na_2CO_3$ solution and then with water. The desulfurized coal had the following composition:

C, 72.20%; H, 4.59%; N, 2.70%; S, 1.03; Ash, 6.6%—BTU/lb. 13.044.

Using the above procedure, 76.7% of the sulfur was removed from the coal. The BTU value of the coal remained practically the same. No oxides of the sulfur were found in the NaOH trap.

EXAMPLE V

A pyrite free coal of the following composition:

C, 72.80%; H, 6.41%; N, 1.77% and S, 1.96% was desulfurized in the presence of kerosine in the apparatus described above. 50 gm. of the pyrite free coal (−100 to +200 mesh) was suspended in 100 gm. of kerosine. Through this suspension a mixture of NO (11.5% by volume) and air (88.5% by volume) was passed at 100° F. The reaction time was 3 hours and the reaction stoichiometry was 3.30. The filtered coal was washed with water at room temperature (72° F.). The analysis of the washed coal showed that 30% of the sulfur was removed. The desulfurized coal had the following composition:

C, 68.60%; H, 5.18%; N, 2.70%; S, 1.38%.

No oxides of sulfur were found in the NaOH trap.

EXAMPLE VI

The experiment described in Example V was repeated in the same manner, except the desulfurized coal was first washed with 1% $Na_2CO_3$ and then with water both at 72°-80° F.

Analysis showed 30% of the sulfur was removed. The desulfurized coal had the following compositions:

C, 69.0%; H, 5.21%; N, 2.60%; S, 1.37%.

No oxides of sulfur were found in the NaOH trap.

EXAMPLE VII

A pyrite free coal was desulfurized in the manner described in Example V.

The coal, after filtration from kerosine, was first washed with 1% $H_2SO_4$ and then with water. Both the washings were carried out at 70-80° F. In this experiment 29% of the total sulfur was removed. The washed, desulfurized coal had the following composition:

C, 69.5%; H, 5.10%; N, 2.90%; and S, 1.40%.

No oxides of sulfur were found in the trap.

EXAMPLE VIII 100 gm. of coal from Tuscaraws, Ohio (Middle Kittanning) containing C, 68.11%; H, 5.14%; N, 1.42%; S, 3.60% was pulverized to −100 to +200 mesh and suspended in 200 gm. of trichloroethylene in a reactor. A mixture of NO and air (10.4% NO and 89.6% air) was passed through the coal-trichloroethylene suspension at 75° F. The reaction time was about 3 hours and the reaction stoichiometry was 6. After the reaction, the coal was filtered and washed twice with water at 30°F. Each time the coal was washed with twice its volume of water. Analysis of the washed coal showed that it contained C, 65.15% H, 4.80%; N, 2.30%; and S, 1.63%. Thus, 55% of the sulfur present in coal was removed by this procedure. No sulfuroxide was found in the NaOH trap.

EXAMPLE IX

The processes set forth in Example VIII was repeated except the reaction was carried out in a solution of nitrobenzene and substantially similar results were achieved.

It will be recognized by those skilled in the art that various modifications may be made in the procedure as hereinbefore set forth, e.g., the organic compounds used as a reaction medium may comprise mixtures of halogenated hydrocarbons like various freons, and chlorinated hydrocarbons like carbon tetrachloride, perchloroethylene, sulfur containing organic compounds like sulfoxides, and dimethyl sulfate and high molecular weight hydrocarbons like kerosine; the concentration of the washing medium $H_2SO_4$ or $Na_2CO_3$ may vary from about 1% to about 40%; and the composition of the mixture No and air may be varied from about 1% NO to about 50% NO by volume and the remainder air.

STATEMENT OF INDUSTRIAL APPLICATION

An improved process for desulfurization of sulfur containing coal is provided which has the following major advantages:

1. No pre-drying of the coal is necessary.
2. The reaction temperature is low at about 72°-100° F.
3. No $SO_2$ or $SO_3$ is evolved.
4. Inexpensive washing agents, for example, $H_2SO_4$ and/or soda ash are used.
5. Because of the presence of an organic liquid, the reaction can be controlled more easily.

I claim:

1. A process for desulfurization of sulfur containing pulverized coal consisting essentially of the steps:

suspending powdered sulfur containing coal in a liquid organic reaction medium generally inert to and a solvent for $NO_x$, and while suspended, introducing NO and oxygen or an oxygen containing gas into the slurry;

washing the reacted coal with water and then with a dilute solution of $H_2SO_4$ or $Na_2CO_3$; and thereafter drying the desulfurized coal.

2. The process defined in claim 1 wherein the reaction medium is selected from the group consisting of aliphatic or aromatic hydrocarbon, nitrated hydrocarbons, nitromethane or nitrobenzene, or halogenated hydrocarbons.

3. The process defined in claim 1 wherein the reaction medium comprises kerosine.

4. The process defined in claim 2 wherein the washing solution comprised 1% solution of $H_2SO_4$ or $Na_2CO_3$.

5. The process defined in claim 1 wherein the mixture of NO and air consisted of NO 11.5% and air 88.5% by volume and the reaction stoichiometry was 3.30.

* * * * *